US005323717A

United States Patent [19]

Gaskin et al.

[11] Patent Number: 5,323,717

[45] Date of Patent: Jun. 28, 1994

[54] REFUSE FEED ASSEMBLY FOR INCINERATORS

[75] Inventors: Matthew J. Gaskin, Williston Park; John A. Harrison, Lake Ronkonkoma; Charles J. Scolaro, Bayville; Michael A. Bertolino, Central Islip, all of N.Y.

[73] Assignee: Leon Industries, Inc., Deer Park, N.Y.

[21] Appl. No.: 986,867

[22] Filed: Dec. 4, 1992

[51] Int. Cl.[5] ..... F23B 1/20

[52] U.S. Cl. ..... 110/291; 110/281; 110/328; 414/173

[58] Field of Search ..... 110/291, 281, 267, 268, 110/285, 289, 290, 328, 114; 14/147, 150, 153, 156, 160, 168, 173-178

[56] References Cited

U.S. PATENT DOCUMENTS

| | | | |
|---|---|---|---|
| 1,818,661 | 8/1931 | Weigel | 110/281 |
| 1,965,317 | 7/1934 | Preston | 110/291 |
| 3,170,577 | 2/1965 | Martin | 414/173 |
| 4,018,168 | 4/1977 | Andregli et al. | 110/38 |
| 4,103,627 | 8/1978 | Mainka | 110/281 |
| 4,111,134 | 9/1978 | Mainka | 110/328 |

FOREIGN PATENT DOCUMENTS

| | | | |
|---|---|---|---|
| 286156 | 10/1988 | European Pat. Off. | 110/291 |

*Primary Examiner*—Henry A. Bennet
*Assistant Examiner*—William C. Doerrler
*Attorney, Agent, or Firm*—Lalos & Keegan

[57] ABSTRACT

An assembly for feeding refuse from a charging chute of an incinerator onto a stoker disposed in the incinerator comprising a stationary support means disposed adjacent the stoker, stationary guide means mounted on the support means in alignment with the stoker, a first movable support means mounted on the stationary support means, movable along a line of travel disposed in alignment with the stoker and having a first ram means operable to advance refuse received from the charging chute toward the stoker upon advancement of the first movable support means, a second movable support means mounted on the first movable support means, movable along the line of travel and having a second ram means operable to advance refuse received from the charging chute toward the stoker upon advancement of the second movable means, means for displacing the first movable means along the line of travel, and the first movable means having means for engaging the second movable means whereby upon advancement of the first movable means along the line of travel, the first movable means sequentially will displace relative to and in unison with the second movable means to correspondingly displace the first and second ram means for advancing and upsetting the refuse.

10 Claims, 3 Drawing Sheets

REFUSE FEED ASSEMBLY FOR INCINERATORS

This invention relates to incinerators and more particularly to an assembly for feeding refuse onto a stoker of an incinerator.

Conventional municipal, industrial and commercial type incinerators typically include a housing structure defining a combustion chamber provided with a refuse charging inlet and an outlet for the gaseous products of combustion, and a stoker disposed within the combustion chamber which is adapted to receive refuse from the charging inlet and advance it to a discharge pit as the refuse is dried, combusted and burned out. Often, the charging inlet consists of a narrow chute in which the refuse is gravity fed onto an upper end of the stoker. Because of the nature of the refuse, it has a tendency to accumulate at the upper end of the stoker and not advance orderly onto and down the length of the stoker to provide a continuous and effective reduction by combustion of the refuse. To remedy such condition, feeder assemblies have been provided in incinerators which utilize a ram to advance the refuse deposited on the upper end of the stoker downwardly onto the stoker where the stoking action of the stoker functions to advance the refuse along the drying, burning and burn out stages of the unit. Typically, such feeder assemblies have consisted of a single ram formed of fabricated steel and a hydraulic cylinder assembly for extending and retracting the ram for advancing the refuse onto the stoker. Such feeder assemblies, however, have been found not to be entirely satisfactory in effectively advancing the refuse and enhancing the combustion process.

Accordingly, it is the principal object of the present invention to provide an improved refuse feeder assembly.

Another object of the present invention is to provide an improved assembly for feeding refuse onto a stoker of an incinerator.

A further object of the present invention is to provide an improved assembly for feeding refuse gravity fed through a charging chute, onto a reciprocating type of stoker of an incinerator.

A still further object of the present invention is to provide an improved assembly for feeding refuse onto a stoker of an incinerator which is effective in preventing the accumulation of refuse on the upper end of a stoker and a corresponding jamming or blockage of the refuse charging means.

Another object of the present invention is to provide an improved refuse feeder assembly for an incinerator which is not only effective in advancing the refuse but enhancing the burning process.

A further object of the present invention is to provide an improved refuse feeder assembly for an incinerator which is effective in both advancing and upsetting the refuse to enhance the burning process.

A still further object of the present invention is to provide an improved refuse feeder assembly adapted for use in conjunction with a reciprocating type of stoker for an incinerator in which various components of the feeder assembly will be interchangeable with certain components of the stoker.

Another object of the present invention is to provide an improved refuse feeder assembly adapted for use with a stoker of an incinerator which is simple in design, effective in performance and easy to service.

Other objects and advantages of the present invention will become more apparent to those persons having ordinary skill in the art to which the present invention pertains from the following description taken in conjunction with the accompanying drawings wherein.

Figure 1:
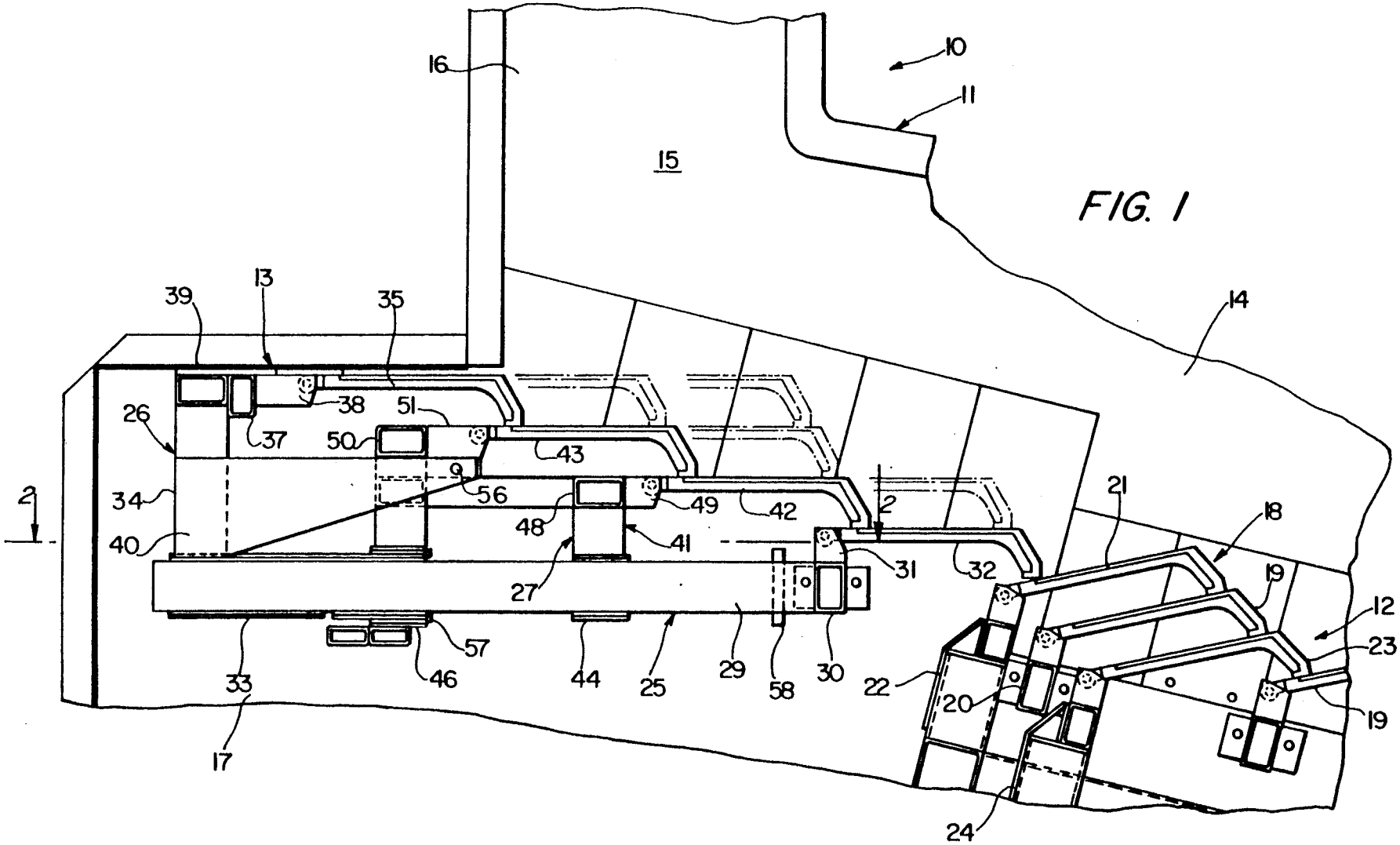
FIG. 1 is a side, vertical cross-sectional view of a refuse feeder system embodying the present invention, having portions thereof broken away.

Referring to FIG. 1, there is illustrated an incinerator 10 generally including a housing structure 11, a stoker 12 and a feeder assembly 13. The housing structure 11 defines a combustion chamber 14 provided with an inlet 15 communicating with a refuse charging chute 16, and an outlet (not shown) through which the products of combustion may flow for further treatment and/or discharge into the atmosphere. The housing structure is of a conventional construction, lined with a refractory, and is provided with burners for igniting refuse deposited on the stoker and air injection nozzles and ports provided in the side walls above and below the stoker to provide variable amounts of overfire and underfire air to combust the refuse deposited on the stoker and to control the combustion process in the conventional manner.

Stoker 12 is of a reciprocating type, generally of the type as illustrated and described in U.S. Pat. Nos. 4,895,084 and 4,913,067. As partially illustrated in FIG. 1, the stoker includes a support structure 17 including a pair of side walls, a front wall and a rear wall, sets of grate units 18 mounted on the side walls of the support structure and closing the upper end thereof, and one or more sifting hoppers closing the lower end of the support structure for receiving and guiding siftings from the grate units to ash extractors provided at the lower ends thereof. The grate unit partially shown in FIG. 1 which is typical of the grate units of the stoker consists of longitudinally spaced, transversely disposed sets of stationary grates 19 supported on cross beams 20 mounted on the side walls of the support structure, an assembly of longitudinally spaced, transversely disposed sets of grates 21 disposed in a first alternate set of spaces between stationary grates 19 supported on a carriage 22 and an assembly of longitudinally spaced, transversely disposed sets of grates 23 disposed in a second alternate set of spaces between stationary grates 19 and supported on a carriage 24. In the operation of the stoker, carriages 22 and 24 are reciprocated to reciprocate moveable grates 21 and 23 in opposite directions to provide a stepping action for upsetting and advancing refuse deposited on the stoker along the length thereof. The different units of the stoker operate to advance the refuse through drying, combusting and burnout stages in maximizing refuse reduction and discharging a burned out ash at the lower end of the stoker into a discharge pit. Conventional drive units are provided on the stoker for reciprocating the sets of carriages of the grate units.

Figure 2:
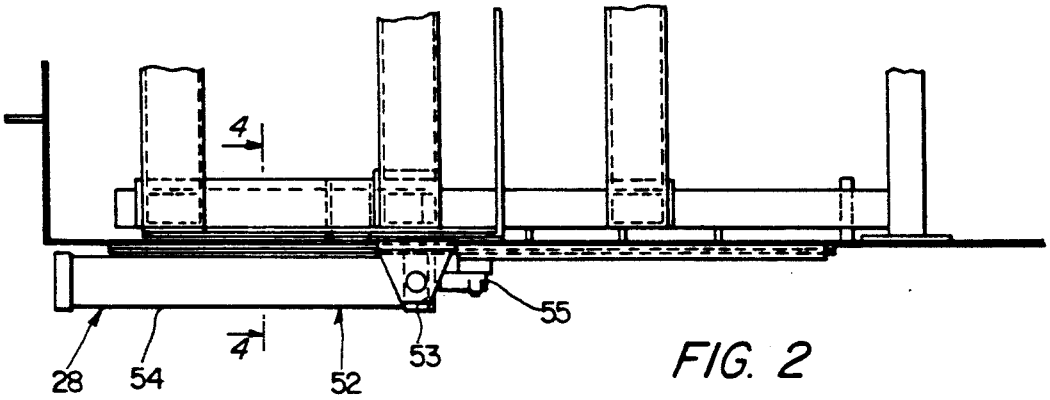
FIG. 2 is a cross-sectional view taken along line 2—2 in FIG. 1.
Figure 3:
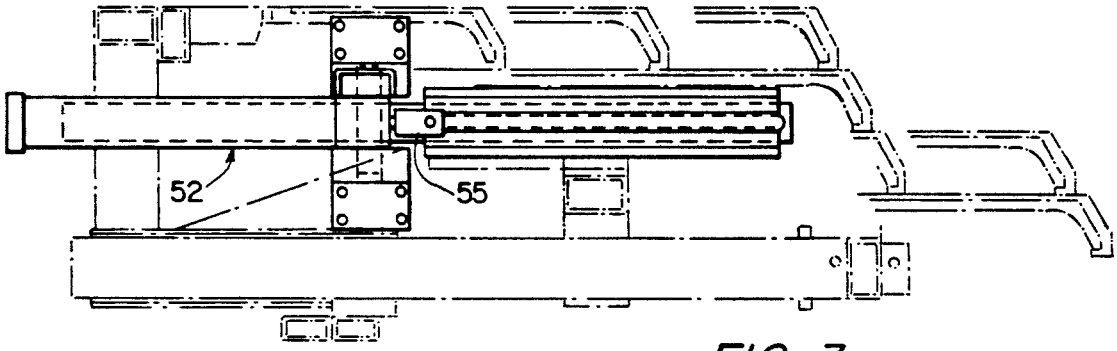
FIG. 3 is a side view of the assembly shown in FIG. 2.
Figure 4:
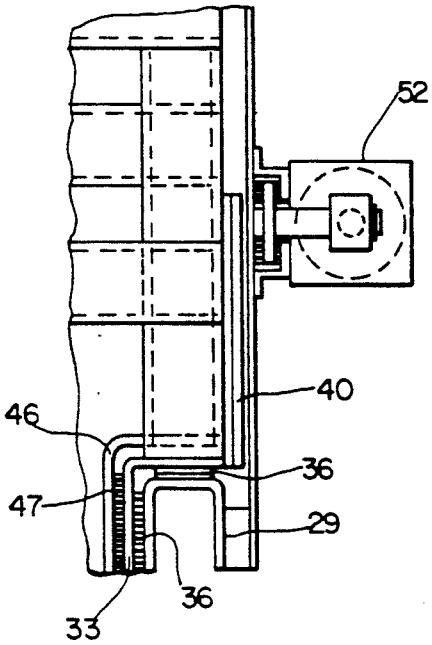
FIG. 4 is an enlarged cross-sectional view taken along line 4—4 in FIG. 2.

Refuse feeder assembly 13 functions to receive refuse charged into the incinerator through charging chute 16, and to advance such refuse onto the upper end of the stoker while upsetting the refuse, to facilitate the advancement of the material and prevent any blockage in the charging chute and enhance the combustion process. The assembly generally includes a support structure 25 mounted on the side walls of support structure 17, a first ram assembly 26 mounted on support structure 25 and displaceable along a longitudinal line of travel, a second ram assembly 27 mounted on the first ram assembly and support structure 25 and displaceable along the line of travel of ram assembly 26, and a drive system as best shown in FIGS. 2 through 4. Support structure 25 consists of a pair of longitudinally disposed, transversely spaced guide rails 29, rigidly secured to a number of cross beams mounted on the side walls of support structure 17. Provided on a forwardly disposed cross beam member 30 is a set of transversely spaced mounting brackets 31 to which there is detachably connected a transversely disposed set of grates 32 having their rear ends supported on cross beam member 30 and the front ends thereof supported on a transversely disposed set of grates 21 provided at the upper end of the stoker.

Ram assembly 26 includes a set of elongated shoes 33, 33, a frame 34 supported on the shoes and a transversely disposed set of grates 35 mounted on the frame. As best shown in FIG. 4, each of guide rails 29 has a substantially rectangular cross-sectional configuration with rounded corners and each shoe 33 has a C-shaped cross-sectional configuration and encompasses three sides of the guide rail. The shoes are adapted to slide along the lengths of the guide rails by means of sets of wear pads 36 mounted on the inner sides of the shoe and engaging the guide rails. The pads may be formed of any suitable material such as plastic, capable of permitting ram assembly 26 to be displaced easily along the lengths of guide rails 29.

Frame 34 consists of a plurality of interconnecting vertical, longitudinal and transverse beam members including a cross beam member 37 on which there is provided a plurality of transversely spaced mounting brackets 38. As best shown in FIG. 1, grates 35 are detachably connected at their rear ends to mounting brackets 38. Provided on frame 34 is a cover plate 39 for preventing refuse from falling through the frame when the ram assembly is advanced forwardly as will later be described. The frame further is provided with a pair of forwardly projecting side brackets 40, 40 to which the drive assembly is connected, also as will later be described.

Ram assembly 27 consists of a frame 41, a first transversely disposed set of grates 42 and a second transversely disposed set of grates 43. The frame is supported on a first set of forwardly disposed set of shoes 44 mounted on guide rails 29 and a second set of rearwardly displaced set of shoes 46 mounted on shoes 33 of ram assembly 26. Shoes 44 are similar in cross-sectional configuration to shoes 33 and are provided with bearing pads on the inner surfaces thereof which engage outer surfaces of guide rail 29 to permit ram assembly 27 to be displaced relative to guide rails 29 and ram assembly 26. Shoes 46 similarly have a C-shaped cross-sectional configuration as best shown in FIG. 4 and are provided with a set of bearing pads 47 which permits ram assembly 27 to be displaced relative to ram assembly 26 along the lengths of shoes 33.

As best seen in FIG. 1, a forwardly disposed cross beam member 48 of frame 41 is provided with a plurality of forwardly projecting, transversely spaced mounting brackets 49 to which the rearward ends of grates 42 are detachably connected. The forward ends of grates 42 are supported on grates 32 and are adapted to slide along the upper surfaces thereof as ram assembly 27 is extended and retracted. Similarly, a rearwardly disposed cross beam member 50 of frame 41 is provided with a plurality of forwardly projecting, transversely spaced mounting brackets 51 to which the rearward ends of grates 43 are detachably connected. The forward ends of grates 43 are supported on grates 42 as shown in FIG. 1. The forward ends of grates 35 are supported on and displaceable along the lengths of grates 43.

Drive system 28 consists of a set of hydraulic cylinder assemblies 52, 52 mounted on the outer sides of the side walls of support structure 17, and operably connected to ram assembly 26. As best shown in FIGS. 2 through 4, a set of brackets 53 is provided on a side wall of the support structure on which there is mounted a cylinder 54 of an assembly 52. The cylinder is provided with a forwardly extendable piston rod 55 which is connected to bracket 40 of ram assembly 26 through a slot in the side wall of support structure 17, as at 56. As fluid under pressure is supplied to the cylinder ends of assemblies 52, the piston rods of the assemblies will be extended in the conventional manner to extend ram assembly 26 forwardly. Conversely, when fluid under pressure is supplied to the rod ends of the assemblies, the piston rods will be retracted to correspondingly retract ram assembly 26.

Figure 5:
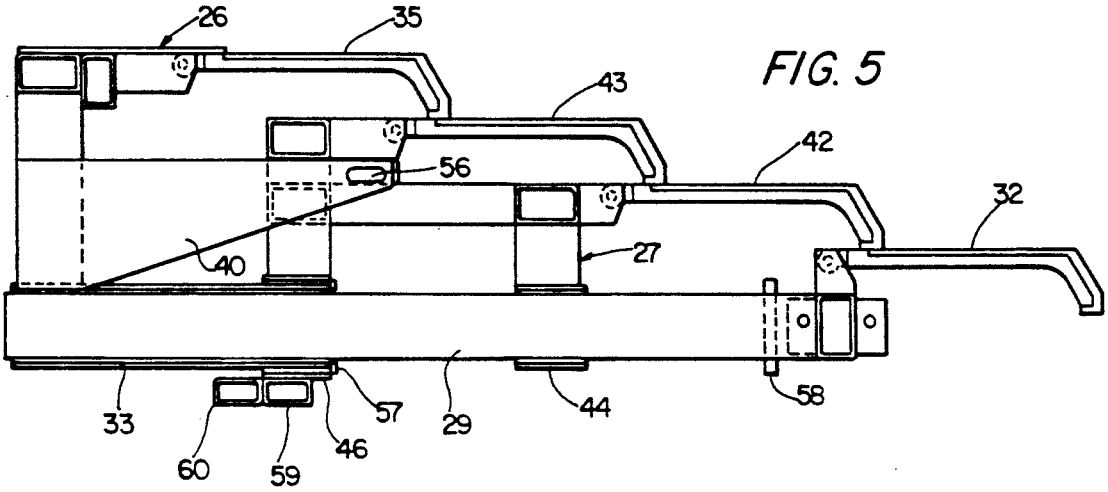
FIG. 5 is a side view of the assembly shown in FIGS. 1 through 4, illustrating the assembly in a fully retracted condition.
Figure 6:
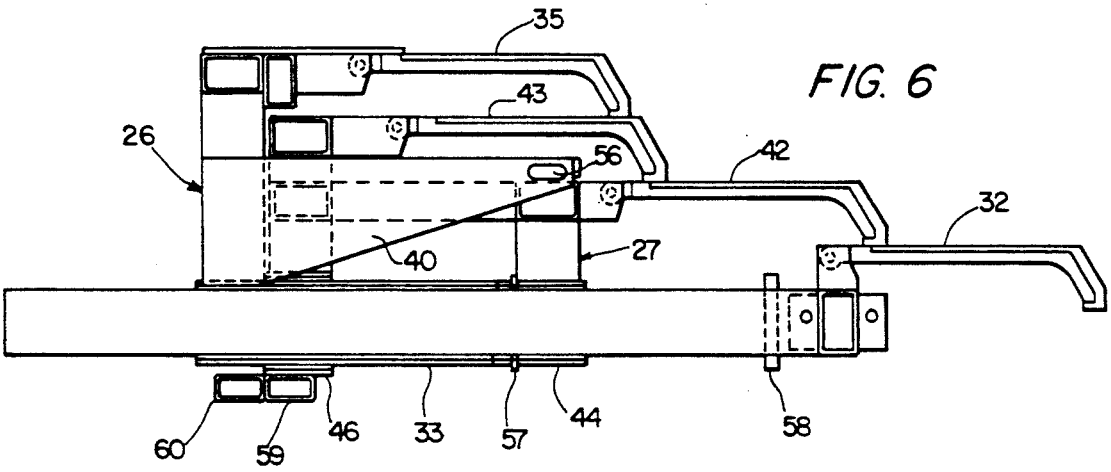
FIG. 6 is a view similar to the view shown in FIG. 5, illustrating the assembly in an intermediate condition.
Figure 7:
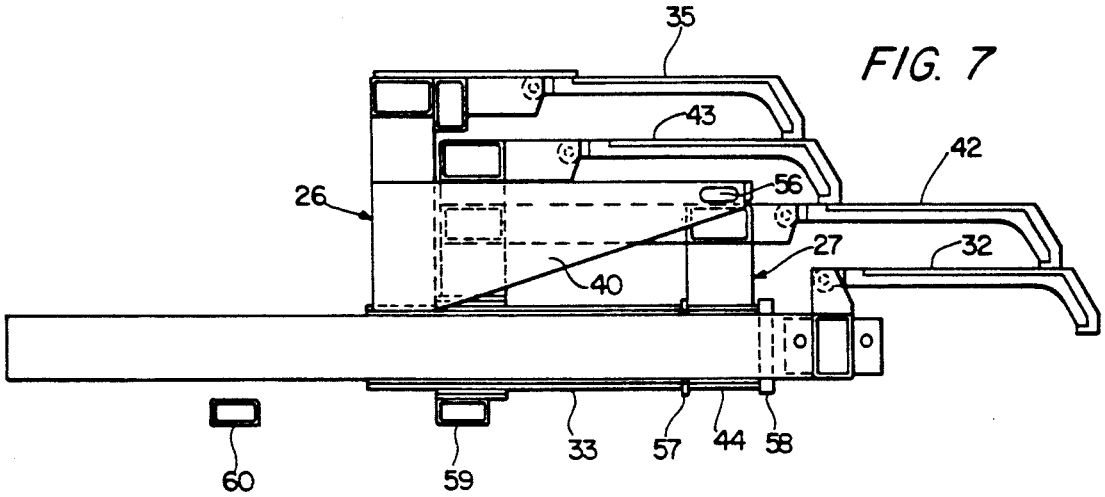
FIG. 7 is a view similar to the views shown in FIGS. 5 and 6, illustrating the assembly in its fully extended condition.

In the operation of the refuse feeder assembly as described, the assembly initially is in the condition as shown in FIG. 5 with ram assemblies 26 and 27 in their fully retracted positions. As refuse is charged through the charging chute, it is deposited on sets of grates 43, 42 and 32. Periodically, the drive system is actuated to cycle the feeder assembly. Upon actuation of the drive system, fluid under pressure is supplied to the cylinder ends of assemblies 52 to extend the cylinders thereof and correspondingly advance ram assembly 26 from the position shown in FIG. 5 to an intermediate position as shown in FIG. 6. As ram assembly 26 advances from its fully retracted to its intermediate position, shoes 33 slide along guide rails 29 within shoe elements 46 until a lug member 57 at the leading end of shoe 33 engages shoe 44 of ram assembly 27. Concurrently, grates 35 will be caused to slide along grates 43 to provide a step of greater depth. As fluid under pressure continues to be supplied to the cylinder ends of assemblies 52, ram assembly 26 will continue to advance and also move ram assembly 27 forwardly from the position shown in FIG. 6 to the position as shown in FIG. 7 by virtue of the engagement of lugs 57 with shoes 44 of ram assembly 27. At such point, the rods of the cylinder assemblies will be fully extended, ram assemblies 26 and 27 will be in their fully extended positions, grates 35 will continue to be positioned above grates 43 to provide a first deep step and grates 42 will be positioned on stationary grates 32 to provide a second deep step. In the course of the sets of grates being advanced and forming steps of different depths, refuse deposited on the grates of the feeder assembly will be caused to be advanced onto the stoker grates and further will be caused to be upset or agitated as it is advanced onto the stoker to more fully expose the refuse and thus enhance the initial combustion process. The forward travel of the ram assemblies is restricted by the engagement of the leading ends of shoes 44 with abutment members 58 formed on the forward ends of the guide rails.

After the ram assemblies have been fully extended to the positions as shown in FIG. 7, an appropriate valve is operated to supply fluid under pressure to the rod ends of cylinder assemblies 52 to retract the ram assemblies. Initially, ram assembly 26 will be retracted with shoes 33 being displaced rearwardly on guide rails 29 and within shoes 46 until lugs 57 engage shoes 46. At such point, grates 35 will be fully retracted relative to grates 43. As fluid under pressure continues to be supplied to the rod ends of the cylinder assemblies, lugs 57 will engage shoes 46 and correspondingly cause ram assemblies 26 and 27 to be returned to their fully retracted positions as shown in FIG. 5, ready to begin another feeding cycle after a predetermined lapse of time. The rearward displacement of ram assemblies 26 and 27 is restricted by the engagement of a cross beam 59 with a cross beam member 60 secured to the side walls of the support structure.

As refuse received from the charging chute is upset and advanced by the feeder assembly onto the upper end of the stoker, the drive system of the stoker is operated periodically to reciprocate the moveable sets of grates thereof and continue to advance the refuse along the length of the stoker as the burning refuse is constantly upset or agitated to enhance the combustion process. At the upper end of the stoker, the refuse essentially is dried and ignited. At the intermediate portion of the stoker, the principal combustion of the refuse occurs. At the lower end of the stoker, burnout occurs to the point where the ash residue is discharged onto a pit conveyor for removal from the incinerator. During the entire process, the overfire and underfire supply is regulated to provide optimum combustion conditions.

The grates used in both the stoker and feeder assembly are similar in size and construction and thus are interchangeable. Preferably, such grates are cast and formed of heat and wear resistant steel. It will be appreciated that such grates may readily be replaced by disconnecting the rear ends of the grates from the mounting brackets, removing any defective grates and installing the replacement grates. The interchangeability of the stoker and feeder assembly grates not only reduces initial manufacturing costs but further reduces maintenance costs and greatly facilitates maintenance of the units.

Since the feeder assembly may be installed in the housing structure of the stoker, it may be provided with a plenum therebelow and a sifting hopper for collecting and extracting siftings. A slightly positive air pressure also can be introduced into such plenum to prevent leakage of combustion gases generated at the upper end of the stoker.

It thus will be appreciated that the feeder assembly as described provides for an orderly turning of refuse within the feed chute while minimizing the possibility of a jamming between the feeder assembly and the arch in the upper wall of the incinerator housing above the feeder assembly. Although the drive system has been described in terms of side mounted cylinder assemblies, it further will be appreciated that such cylinders may be positioned elsewhere, including at the rear of the unit if space allows. Furthermore, rotary drive units may be used in the drive system which require the least amount of space and less maintenance.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An assembly for feeding refuse from a charging chute of an incinerator onto a stoker disposed in said incinerator comprising:

stationary support means disposed adjacent said stoker;

stationary guide means mounted on said support means in alignment with said stoker;

a first movable support means mounted on said stationary support means, movable along a line of travel disposed in alignment with said stoker and having a first ram means operable to advance refuse received from said charging chute toward said stoker upon advancement of said first movable support means;

a second movable support means mounted on said first movable support means, movable along said line of travel and having a second ram means operable to advance refuse received from said charging chute toward said stoker upon advancement of said second movable means;

means for displacing said first movable means along said line of travel;

said first movable means having means for engaging said second movable means whereby upon advancement of said first movable means along said line of travel, said first movable means sequentially will displace relative to and in unison with said second movable means to correspondingly displace said first and second ram means for advancing and upsetting said refuse;

said first ram means comprising a transversely disposed set of uppermost grates supported on said first movable means and said second ram means;

said second ram means comprising at least one transversely disposed set of intermediate grates supported on said second movable means and said stationary guide means; and said stationary guide means comprising a transversely disposed set of lowermost grates supported on said stationary support means and said stoker.

2. An assembly according to claim 1 wherein said grates are interchangeable with grates of said stoker.

3. An assembly according to claim 1 wherein said second ram means comprise first and second longitudinally displaced, transversely disposed sets of grates, said first set of grates being supported on said second movable means and said second set of grates, and said second set of grates being supported on said second movable means and said stationary guide means.

4. An assembly according to claim 3 wherein said first and second set of grates are interchangeable with grates of said stoker.

5. An assembly according to claim 1 including second guide means mounted on said stationary support means and wherein said first movable support means is slidably mounted on said second guide means for displacement therealong.

6. An assembly according to claim 5 including third guide means mounted on said first movable means and wherein said second movable support means is slidably mounted on said third guide means for displacement therealong relative thereto.

7. An assembly according to claim 1 wherein said first movable means includes a lug engageable with a first surface of said second movable means when said first movable means is advanced in a forward direction to advance said second movable means forwardly, and engageable with a second surface of said second movable means when said first movable means is retracted in a rearward direction to retract said second movable means rearwardly.

8. An assembly according to claim 7 wherein said first and second surfaces of said second movable means are spaced longitudinally.

9. An assembly according to claim 1 wherein said displacing means comprises at least one hydraulic cylinder assembly operatively interconnecting said stationary support means and said first movable means.

10. An assembly according to claim 9 wherein said hydraulic cylinder assembly is mounted on a side wall of said stationary support means.

* * * * *